United States Patent [19]

Gillis

[11] 3,971,157

[45] July 27, 1976

[54] BUBBLE MACHINE WITH PROTECTIVE TRANSPARENT DOME

[76] Inventor: Robert E. Gillis, P.O. Box 67, Aptos, Calif. 95003

[22] Filed: Nov. 3, 1975

[21] Appl. No.: 628,282

[52] U.S. Cl. ..... 46/7

[51] Int. Cl.[2] ..... A63H 33/28

[58] Field of Search ..... 46/6, 7, 8; 40/106.21, 40/106.22, 106.23

[56] References Cited

UNITED STATES PATENTS

| | | | |
|---|---|---|---|
| 1,028,994 | 6/1912 | Cordtmeyer | 46/6 |
| 1,458,050 | 6/1923 | Chester | 40/106.21 |
| 1,804,519 | 5/1931 | Smith et al. | 40/106.21 |
| 2,137,034 | 11/1938 | Sturm | 46/7 |
| 2,225,702 | 12/1940 | Lyon | 40/106.23 X |
| 2,274,052 | 2/1942 | Feder | 46/7 |
| 2,587,895 | 3/1952 | Quinn et al. | 46/7 |
| 2,675,641 | 4/1954 | Baggott | 40/106.22 X |
| 3,600,842 | 8/1971 | Bryman | 46/6 |

*Primary Examiner*—F. Barry Shay

*Attorney, Agent, or Firm*—Sughrue, Rothwell, Mion, Zinn & Macpeak

[57] ABSTRACT

A device for forming bubbles in the nature of a toy or amusement device has a weighted base defining a space to contain a quantity of soapy solution. An air introduction conduit extends into the space, and the area is enclosed by a transparent dome.

5 Claims, 3 Drawing Figures

FIG. 1
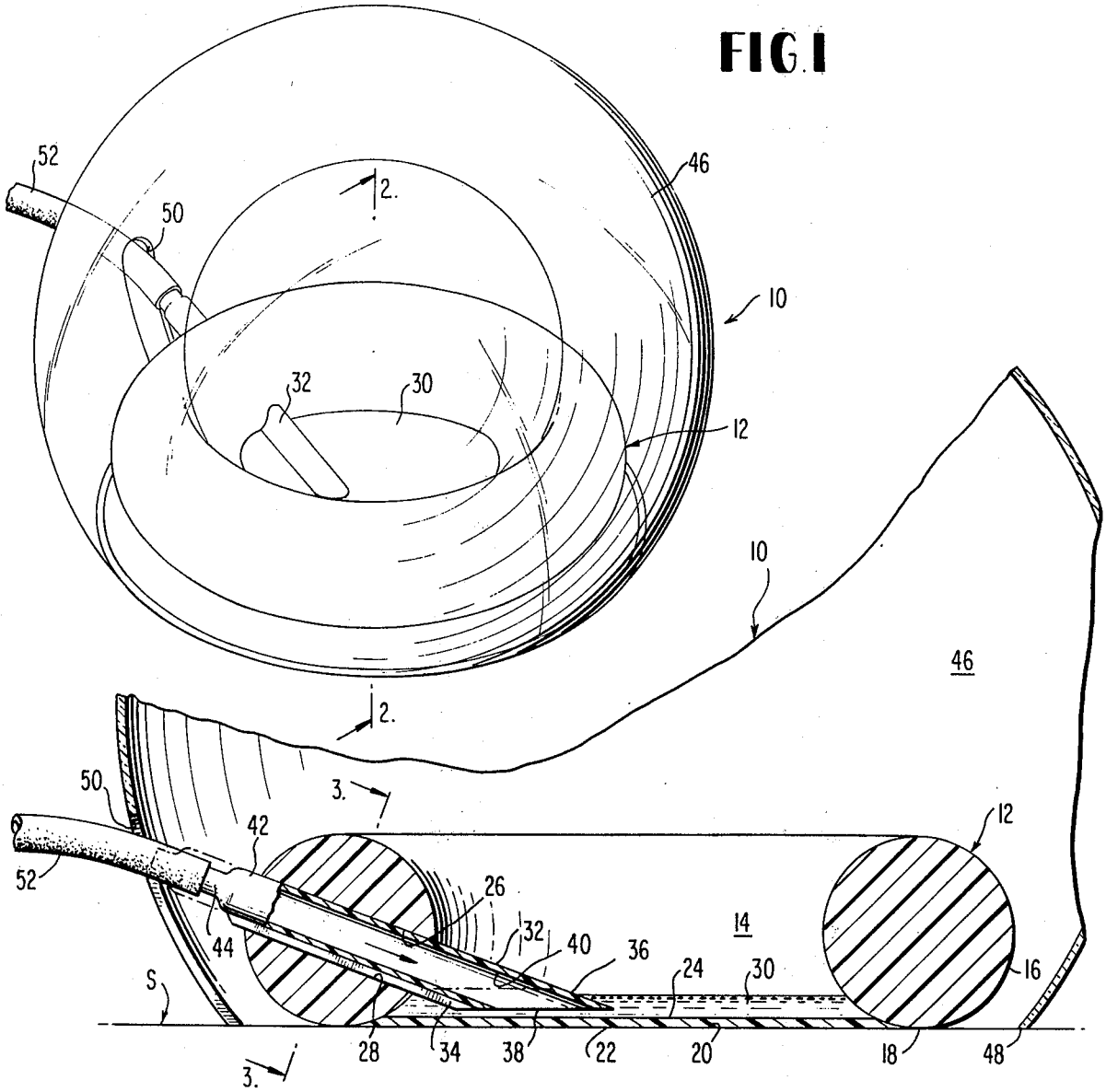
FIG. 2
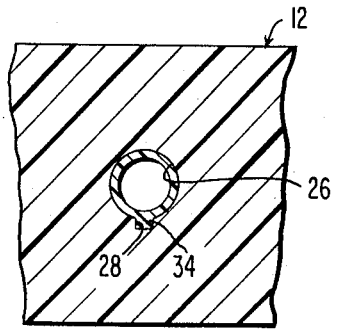
FIG. 3

BUBBLE MACHINE WITH PROTECTIVE TRANSPARENT DOME

BACKGROUND OF THE INVENTION

1. Field of the Invention

This invention pertains to an amusement device for forming bubbles, and to a temporary preservation of the bubble by shielding it from ambient air effects.

2. Statement of Prior Art

Prior art devices in this general structural or functional area are representatively shown in the following U.S. patents:

| Pat. No. | Patentee | Issued |
|---|---|---|
| 2,274,052 | Feder | Feb. 24, 1942 |
| 2,396,433 | Pimblett | Mar. 12, 1946 |
| 3,060,626 | Panico, Jr. | Oct. 30, 1962 |
| 3,473,253 | Jakubowski et al | Oct. 21, 1969 |

SUMMARY OF THE INVENTION

This invention comprises a toy for the production of a variety of bubble effects, and a device which also serves to temporarily shield the resulting bubbles from the ambient atmosphere thus creating a decorative effect. The shield is constructed of transparent material so that the effect can be viewed.

The device incorporates a weighted base with a conduit for introduction of air. Within the base a quantity of bubble forming solution is disposed. The conduit is changeably mounted whereby its depth in the solution is variable to produce a variety of bubble effects.

A further objective is to provide, in a device as aforesaid, a conduit which prevents withdrawal of the solution therethrough.

Other and further objects and advantages of the invention will become apparent to those skilled in the art from a consideration of the following specification when read in conjunction of the annexed drawing.

BRIEF DESCRIPTION OF THE DRAWING

FIG. 1 is a perspective view of a bubble machine according to this invention;

FIG. 2 is an enlarged sectional view taken substantially on line 2—2 of FIG. 1, looking the in the direction of the arrows; and FIG. 3 is a detail cross sectional view on line 3—3 of FIG. 2, looking in the direction of the arrows.

DESCRIPTION OF THE PREFERRED EMBODIMENT

Referring to the drawing in more detail, the device of this invention is generally indentified therein by reference numeral 10. The device comprises a weighted annular ring 12 which forms the main body section of the apparatus. The ring 12 is of circular section as shown in FIG. 2, and includes inner and outer sides 14,16 and a base 18. Fixedly secured to the ring and spanning its area across the base 18 is a base wall 20 having a bottom surface 22 and a top surface 24. Both the ring 12 and base wall 20 are formed of rigid plastic or similar material. The base 18 of the ring and the bottom surface 22 of the base wall are adapted to rest on a supporting surface S such as a table top or floor.

The ring 12 has a slant bore 26 formed therein extending angularly downward from the outer side 16 to the inner side 14. The bore 26 terminates on the inner side at a location elevated in relation to the base wall 20. The bore is generally circular in cross section, and a rectangular slot 28 is formed in the ring to open on the downward or lower side of the bore.

The ring 12 and the base wall 20 define a shallow receptacle for a quantity of bubble forming fluid 30. Examples of fluids acceptable for this purpose are soap solutions, detergents, and the like. The fluid is added to a level below the bore entry location in the ring inner side and rests against the ring and the top surface 24 of the base wall.

An elongated tube 32 is mounted in the bore 26 for inward and outward sliding movement. The tube 32 has a rib 34 projecting therefrom dimensioned for slidable engagement in the slot 28 to prevent turning of the tube during sliding. Avoidance of turning or twisting is desirable inasmuch as the tube inner end 36 has a slant edge 38 adapted to be maintained in substantially parallel relation to the base wall 20 and immersed in the solution 30. The tube is hollow and has a through passageway 40 therein of a size such that it is unlikely that solution could be withdrawn therefrom during air introduction. The outer end 42 of the tube projects from the rim ring, and terminates in a reduced diameter nipple 44.

A generally spherical transparent dome 46 has a truncated base edge 48 adapted to be supported on the surface S about the ring. The dome surrounds the ring in outwardly spaced relation thereto, and has an opening 50 formed therein. A flexible air hose 52 extends through the opening 50 and is frictionally engaged on the nipple 44 of the tube.

In operation, air is supplied through the hose and tube into the solution. This results in the formation of one or more bubbles. The bubble effect is protected by the dome and is relatively long lasting. Different effects are created by inward and outward movement of the tube during the air supply operation.

I claim:

1. A bubble effect device comprising:

a weighted annular ring having a base wall fixed thereto said ring and base wall being adapted to rest on a supporting surface;

the ring having a slant bore formed therein;

a tube extending through the bore;

a quantity of bubble forming fluid solution on the base wall;

means for protecting the bubble effect to make it relatively long lasting, said means comprising a protective transparent dome adapted to rest on said surface about the ring; and hose means connected to the tube and extending outwardly of the dome to introduce air therethrough into the solution.

2. The invention of claim 1, wherein:

the tube is slidably mounted in the bore.

3. The invention of claim 2, and:

means on the tube to prevent rotation thereof.

4. The invention of claim 3, wherein:

said means comprises a longitudinal rib on the tube; and the ring having a slot opening on the bore in which the rib is disposed.

5. A bubble effect device comprising:

a weighted annular ring having inner and outer sides and having a base;

a base wall on said annular ring closing the base thereof, the base and base wall being adapted to rest on a supporting surface;

the ring having a slant bore formed therein extending from side-to-side and terminating on the inner side at a location elevated with respect to the base, and on the outer side at a location elevated with respect to the inner side;

the bore being circular in cross section;

the ring having a slot formed therein opening on the bore and co-terminus therewith;

a quantity of bubble forming fluid contained in the space defined by the base wall and base below the bore;

a tube slidably mounted in the bore, the tube having a rib projecting therefrom with the rib slidably engaged in the slot, the tube having an outer end and a slant edge inner end, the slant edge being substantially parallel to the base wall and extending into the solution;

a reduced diameter nipple on the outer end of the tube extending outwardly of the annular ring;

a generally transparent spherical dome, having a truncated base edge adapted to rest on said supporting surface, the dome surrounding the annular ring in spaced relation thereto;

the dome having an opening formed therein; and a flexible air hose extending through said opening in said dome and engaged on said nipple whereby the introduction of air through said hose and said tube to said solution forms one or more bubbles within the dome.

* * * * *